United States Patent [19]

Nguyen

[11] Patent Number: 4,997,494

[45] Date of Patent: Mar. 5, 1991

[54] CHEMICALLY GASSED EMULSION EXPLOSIVE

[75] Inventor: Anh D. Nguyen, Brossard, Canada

[73] Assignee: ICI Canada Inc., North York, Canada

[21] Appl. No.: 552,526

[22] Filed: Jul. 16, 1990

[51] Int. Cl.[5] ..... C06B 45/00

[52] U.S. Cl. ..... 149/2; 149/21; 149/45; 149/46; 149/61; 149/112; 149/109.6

[58] Field of Search ..... 149/2, 21, 45, 46, 61, 149/112, 109.6

[56] References Cited

U.S. PATENT DOCUMENTS

| | | | |
|---|---|---|---|
| 3,447,978 | 6/1969 | Bluhm | 149/2 |
| 3,706,607 | 12/1972 | Chrisp | 149/2 |
| 3,886,010 | 5/1975 | Thornley et al. | 149/60 |
| 4,008,108 | 2/1977 | Chrisp | 149/2 |
| 4,711,678 | 12/1987 | Ehrnstrom | 149/2 |
| 4,911,770 | 3/1990 | Oliver et al. | 149/2 |
| 4,919,178 | 4/1990 | Riga et al. | 149/2 |
| 4,919,179 | 4/1990 | Chattopadhyay | 149/2 |
| 4,936,931 | 6/1990 | Nguyen et al. | 149/2 |
| 4,936,932 | 6/1990 | Nguyen | 149/2 |

FOREIGN PATENT DOCUMENTS 1244463 11/1988 Canada .

*Primary Examiner*—Stephen J. Lechert, Jr.
*Attorney, Agent, or Firm*—C. Brian Barlow

[57] ABSTRACT

A process for the production of a chemically gassed emulsion explosive wherein a chemical gassing agent is added to the emulsion as an essentially dry particulate powder. The process allows for the production of stable emulsion explosives which have more controllable emulsion explosive characteristics.

11 Claims, No Drawings

CHEMICALLY GASSED EMULSION EXPLOSIVE

FIELD OF THE INVENTION

The present invention is related to emulsion explosives and, more particularly, to emulsion explosives that have been sensitized by chemical gassing agents.

DESCRIPTION OF THE RELATED ART

Semi-solid colloidal dispersions of water-bearing blasting agents are well known. These products typically comprise an oxidizing component, usually predominantly ammonium nitrate, a fuel component, and water. These blasting agents are referred to in the art as water gels or slurry explosives, and emulsion-type blasting agents.

Slurry explosives typically comprise a discontinuous fuel phase which is dispersed in a continuous aqueous solution of the oxidizer salt. Thickening agents are added to the aqueous phase in order to effect gelation and, thus, stabilize the structure of the explosive.

Emulsion explosives, as described by Bluhm in U.S. Pat. No. 3,447,978, typically comprise a discontinuous aqueous oxidizer salt solution which is dispersed in a continuous fuel phase. Emulsifying agents are added to stabilize the dispersion.

The addition of additives to both slurry and emulsion explosives to modify the performance of the blasting agent is similarly well known. These additives include, for example, the addition of TNT to the emulsion to increase sensitivity.

Of particular interest in the present invention is the addition of additives to create small air voids within the blasting agent which air voids increase the sensitivity of the explosive. One method of addition of air voids is the addition of glass microballons, which contain an air void of the desired size for the explosive used. While this method provides a suitable means for the creation of the air voids, the microballons are relatively expensive and can be difficult to handle, due to their low bulk density.

In-situ generation of air or gas voids within the blasting agent is an alternative method to glass microballoons and, typically, comprises the addition of materials which react in the explosive to generate a gas bubble. This gas bubble is entrained within the blasting agent by the viscous nature of the semisolid blasting agent. The generation of a gas void within the blasting agent by an in-situ chemical reaction is termed within the industry as chemical gassing.

Chemical gassing of explosives in order to increase the sensitivity of the explosive is well known in the slurry and emulsion explosive industry. In U.S. Pat. Nos. 3,886,010 (Thornley) and 3,706,607 (Chrisp) the use of chemical gassing agents such as, nitrites, weak acids, hydrazine, and peroxides in slurry and/or emulsion explosives is disclosed.

Chrisp, in U.S. Pat. No. 4,008,108 also discloses the use of similar chemicals in emulsion explosives.

Chemical gassing is accomplished in the industry by the addition of an aqueous solution of the chemical gassing agents. The addition of an aqueous solution of sodium nitrite is generally preferred. While this addition route has been successfully utilized, problems exist in the production of a chemically gassed blasting agent.

In practice, chemical gassing with sodium nitrite is accomplished by injecting an aqueous solution of sodium nitrite into a hot emulsion, followed by mixing and cartridging of the resultant sensitized blasting agent. Gassing occurs as the nitrite reacts with ammonium ions present in the blasting agent to produce a gaseous product. This reaction to generate the gaseous product occurs both during the mixing and the cartridging stages. This technique has several difficulties, such as: (a) the nitrite solution cannot be dispersed to micron size droplets in the short mixing time used in industrial practice and, thus, produces large gas bubbles; (b) refining the resultant large gas bubbles into smaller bubbles requires extensive mixing and the beneficial effects achieved by the mechanical refinement of the gas bubbles is offset by coalescence of the gas bubbles and the tendency of the hot blasting agent to degas; and (c) the gassing reaction continues after packaging, thus making it difficult to obtain controlled densities and bubble sizes.

SUMMARY OF THE INVENTION

It has now been found that a chemically gassed blasting agent can be readily prepared by addition of an essentially dry particulate chemical gassing agent to the water-bearing blasting agent.

It is an object of the present invention to provide an improved process for the production of a chemically gassed blasting agent.

It is a further object of the present invention to provide an improved emulsion explosive which explosive comprises a chemical gassing agent.

Accordingly, the present invention provides in a process for the production of a chemically gassed emulsion explosive comprising:

(a) mixing a liquid fuel component with an effective amount of a suitable emulsifying surfactant to prepare a fuel/surfactant admixture;

(b) mixing an oxidizer salt component with said admixture in order to prepare an emulsion explosive;

(c) adding a chemical gassing agent to said emulsion explosive; and (d) reacting said gassing agent in said emulsion explosive to effect production of a chemically gassed blasting agent, wherein the improvement comprises that said gassing agent is added as an essentially dry particulate material.

DESCRIPTION OF PREFERRED EMBODIMENTS

Preferably, the gassing agent is an alkali nitrite and, most preferably, sodium nitrite. However, other dry particulate materials, such as, carbonates or weak carboxylic acids which produce gas bubbles under certain chemical, catalyst, pH or temperature conditions, may also be utilized.

The optimum particle size of the dry material added will vary depending on the gassing agent selected, the desired gas bubble size, and process conditions used. For sodium nitrite, a suitable particle size for the dry material has been found to be in the range of 37 μm to 500 μm and, preferably, between 37 μm and 74 μm.

The particulate gassing agent may be added to the fuel phase prior to production of the emulsion explosive but is, most preferably, added after the explosive has been prepared.

Addition of the sodium nitrite to the emulsion explosive as a dry particulate material can be accomplished using a low shear mixing method such as an in-line static mixer, or can be achieved using more conventional low shear rotating mixers. High shear mixing can be utilized but is unnecessary and may be dangerous for the sensitized explosive which is produced.

Depending on the chemical gassing agent used, it may be desirable to heat or maintain the emulsion at a temperature of at least 70° C. and, more preferably, at a temperature of at least 95° C. This is particularly desirable when sodium nitrite is used as the gassing agent since the gassing reaction rate is generally too low below a temperature of about 50° C. to be effective However, this low reaction rate below 50° C. allows for a method to further control the amount of chemical gassing by controlling the temperature profile of the chemical gassing reaction This control also allows for improved long term package stability of the cartridged emulsion explosive.

The fuel component used may be any liquid or liquefiable fuel known within the emulsion explosive art. Suitable materials include mineral oil, waxes, paraffin oils, benzene, toluene, xylenes, and mixtures of petroleum distillates such as, gasoline, kerosene and diesel fuel.

Suitable oxidizer salt components are oxygen containing salts such as, for example, nitrates, chlorates, and perchlorates, wherein the oxygen is used in the explosive reaction. These oxidizer salts include ammonium nitrate, sodium nitrate, calcium nitrate, potassium nitrate, or mixtures thereof. The oxidizer salt component can be added as a liquefied melted material or may be, preferably, added as an aqueous solution, which solution is heated to increase the solubility of the oxidizer salts.

Suitable surfactants include any known surfactants for emulsion explosives but, most preferred, is a mixture of sorbitan sesquioleate and a polyisobutylene succinic anhydride (PIBSA) based surfactant. These PIBSA based surfactants were first described in Canadian Patent No. 1,244,463 (Baker).

During production of the chemically gassed blasting agent, other additives such as, TNT, PETN, NG, the addition of which are known within the emulsion explosive art, may be added to modify the properties of the blasting agent produced.

Further, additives which act as activators or accelerators for the chemical gassing reaction, can also be added. These accelerators include, for example, thiocyanates, acetates, and thiourea when nitrite gassing agents are used.

In a second aspect, the present invention also provides an emulsion explosive comprising:

(i) a continuous fuel phase;

(ii) a discontinuous aqueous oxidizer salt phase: and (iii) a chemical gassing agent wherein said gassing agent was added to said emulsion explosive as an essentially dry particulate material.

Preferably, the emulsion explosive is prepared by the inventive process described hereinabove.

The present invention, thus, provides a process for achieving a controllable gassing reaction rate by controlling the particle size of the dry gassing agent added. As a result, the gas bubble size and distribution in the emulsion explosive can be readily controlled. This controllability allows the formulator to cartridge the emulsion explosive shortly after the chemical gassing agent has been added, and allow the gassing reaction to occur in the cartridge. Given the controllability of the gassing reaction, previously observed problems of poor distribution of the bubbles and splitting of the cartridge due to excessive gassing, are greatly reduced.

In a further aspect, the present invention also provides an emulsion explosive comprising:

(i) a continuous fuel phase;

(ii) a discontinuous aqueous oxidizer salt phase; and (iii) a chemical gassing agent wherein said gassing agent was added to said emulsion explosive as an essentially dry particulate material.

Further, the present invention also provides an emulsion explosive when said explosive is prepared according the process of the present invention as described hereinabove.

EXAMPLES

The invention will now be described, by way of example only, with reference to the following examples.

In all of the examples, the emulsion explosive was prepared according to the following procedure.

The surfactants, oils, and waxes were weighed and added to a steam jacketed, heated Hobart mixing bowl at 90° C. to 105° C. and, where necessary, the ingredients were melted by the steam heat.

*Trade Mark

The aqueous oxidizer phase consisting of 77% ammonium nitrate, 11% sodium nitrate and 12% water was prepared separately and kept at 90° C.

While mixing with a whisk-shaped mixer at 285 r.p.m., the aqueous phase was slowly added to the oil phase in the Hobart mixer. A coarse emulsion was formed upon addition of the aqueous phase. Refinement of the coarse emulsion was done at high speed on the mixer for 3 minutes at 581 r.p.m.

The solid particulate chemical gassing agent was manually mixed into the emulsion at the processing temperature or in the cooled emulsion. To improve the dispersion of the gassing agent, the emulsion was additionally mixed on the Hobart mixer at a lower speed using a "V-shaped" blade.

The gassing agent-containing emulsion was then transferred to a hopper and was packaged in a 25 mm diameter tube shaped cartridges. About 30% of each cartridge was left empty to allow for the expansion of the gassed emulsion.

The un-gassed emulsion explosive had a density of about 1.45 g/cc.

The sealed cartridges were caused to gas by heating the packages cartridges in a hot water bath at 95° C. for 5 minutes to one hour.

The following testing procedures were used:

The emulsion density was determined by the ratio of the cartridged weight to the cartridged volume obtained by the difference of the cartridged weight in air and in water.

$$g/cc = \frac{\text{cartridged weight in air}}{\text{cartridged weight in air-cartridged weight in water}}$$

Bubble sizes were determined on 50× magnification photographs taken by transmitted light optical microscope.

The cap sensitivity of the gassed emulsion was measured in 25 mm diameter cartridges by checking for detonation of the emulsion explosive with a series of caps with different pentaerythritol tetranitrate (PETN) levels. A smaller "cap" number indicated that the emulsion is more sensitive.

| Cap | PETN Base Charge |
|---|---|
| R4 | 0.05 g |
| R5 | 0.10 g |
| R6 | 0.15 g |
| EB | 0.78 g |

The velocity of detonation (V.O.D.) was determined by measuring the time for the detonation wave to travel 2.5 inches (6.35 cm) for a 25 mm diameter sample initiated with an EB cap.

EXAMPLES 1 TO 3

Emulsion explosives were prepared according to the procedure described hereinabove using the formulations shown in Table 1. Also shown in Table 1 are the properties of the resultant emulsion explosive for each formulation. In Examples 1, 2 and 3, the level of sodium nitrite has been varied to observe the effect on the emulsion density after gassing.

TABLE 1

Effect of Nitrite Concentration on Emulsion Density

| EXAMPLE NO. | 1 | 2 | 3 |
|---|---|---|---|
| E-476[1](PIBSA based surfactant) | 2.0 | 2.0 | 2.0 |
| Sorbitan sesquioleate | 0.5 | 0.5 | 0.5 |
| Polyurethane wax | 1.2 | 1.2 | 1.2 |
| Microcrystalline wax | 0.6 | 0.6 | 0.6 |
| Paraffin oil | 1.2 | 1.2 | 1.2 |
| Oxidizing liquor[2] | 94.433 | 94.417 | 94.4 |
| Sodium nitrite powder (37 to 44 micron) | 0.067 | 0.083 | 0.100 |
| Emulsion Density (g/cc) | 1.21 | 1.15 | 1.10 |
| Cap sensitivity | R5 | R5 | R5 |
| V.O.D. (km/sec) | 3.8 | 4.4 | 4.4 |
| Gassing Yield (%)[3] | 63.0 | 65.5 | 68.5 |

[1]E-476 is a PIBSA based surfactant produced by reacting a 1 to 1 molar ratio of polyisobutylene-succinic anhydride and diethanolamine.
[2]The oxidizing liquor has the composition of 77% ammonium nitrate, 11% sodium nitrate and 12% water.
[3]The gassing yield is the percentage of the amount of gas required to reduce the emulsion from 1.45 g/cc to its measured density, compared to the theoretical amount of gas that would be generated by the level of sodium nitrite used, according to the reaction: $NO_2^- + NH_4^+ \rightarrow N_2 + 2H_2O$ The results indicate that particulate sodium nitrite can be used to generate gas bubbles in an emulsion explosive, and that the level of generated gas increases with increased levels of sodium nitrite added.

Further, the level of gas generated is directly related to the emulsion density. The results also indicate the the gassed emulsion according to the present invention has good cap sensitivity and high velocity of detonation.

EXAMPLES 4 to 7

The effect of the sodium nitrite particle size on bubble size was studied by preparing a series of emulsion explosives that had been chemically gassed with sodium nitrite particles that had been classified by particle size. All of the emulsion explosives tested had the following formulation:

| | |
|---|---|
| E-476 (PIBSA based surfactant) | 2.0 |
| Sorbitan sesquioleate | 0.5 |
| Polyethylene wax | 1.2 |
| Microcrystalline wax | 0.6 |
| Paraffin oil | 1.2 |
| Oxidizing liquor | 94.2 |
| Sodium nitrite powder | 0.3 |

The results from this study are shown in Table 2.

TABLE 2

Effect of Sodium Nitrite Particle Size

| EXAMPLE NO. | 4 | 5 | 6 | 7 |
|---|---|---|---|---|
| Sodium nitrite particle size (μm) | >74 | 44–77 | 37–44 | <37 |
| Bubble size (μm) | 44.4 | 42.8 | 38.2 | 30.8 |
| std. dev. (microns) | 38.6 | 35.6 | 37.7 | 19.8 |
| Minimum primer | R4 | R4 | R4 | R5 |
| V.O.D. (m/sec) | 4043 | 4047 | 4872 | 4383 |
| std. dev. (m/sec) | 884 | 591 | 108 | 59 |

It can be clearly seen that the bubble size is directly dependent on the sodium nitrite particle size. Thus, it is apparent that this emulsion characteristic can be controlled by the method of the present invention.

In order to further investigate the present invention, a series of trials were conducted to determine the effect of particle size on the gassing rate of the emulsion prepared. The results of this trial, using the formulations shown for the emulsions characterized in Table 2, are shown in Table 3. The emulsion was held at 95° C. for the time periods shown in Table 3.

TABLE 3

Effect of Particle Size on Gassing Rate

| EXAMPLE NO. | 4 | 5 | 6 | 7 |
|---|---|---|---|---|
| Sodium nitrate particle size (μm) | >74 | 44–74 | 37–44 | <37 |
| Density (g/cc) Time (min): | | | | |
| 0 | 1.43 | 1.42 | 1.40 | 1.38 |
| 10 | 1.36 | 1.32 | 1.27 | 1.25 |
| 20 | 1.30 | 1.23 | 1.17 | 1.16 |
| 30 | 1.26 | 1.14 | 1.10 | 1.10 |
| 40 | 1.22 | 1.06 | 1.04 | 1.04 |
| 50 | 1.20 | 1.00 | <1.0 | <1.0 |
| 60 | 1.18 | — | — | — |
| 70 | 1.18 | — | — | — |

The results show that the reduction in density increases as the particle size becomes smaller. It was observed that the gassing rate for particles in the range of 37 to 74 microns was reasonably rapid, while for particle sizes above 74 microns, the gassing rate became noticably slower. With a coarse sodium nitrite powder with a particle size of 500 microns, the rate of reaction was found to be extremely slow with only a 0.1 g/cc reduction in density after 6 hours in a 95° C. water bath (example not shown).

The emulsion explosive formulation of Examples 4 to 7 with a sodium nitrate particle size of 37–44 μm was used to study the effect of temperature on the gassing rate of the emulsion. The results are shown in Table 4.

TABLE 4

Effect of Temperature on Gassing Rate

| TEMPERATURE °C. | 50° C. | 70° C. | 80° C. | 97° C. |
|---|---|---|---|---|
| Density (g/cc) Time (min): | | | | |
| 0 | 1.42 | 1.43 | 1.41 | 1.41 |
| 10 | 1.40 | 1.37 | 1.34 | 1.22 |
| 20 | 1.39 | 1.35 | 1.27 | 1.09 |
| 30 | 1.39 | 1.32 | 1.24 | 1.02 |
| 40 | 1.38 | 1.29 | 1.22 | <1.0 |
| 50 | 1.38 | 1.28 | 1.21 | — |
| 60 | 1.38 | 1.27 | 1.18 | — |
| 70 | 1.38 | — | — | — |

As might be expected, the gassing reaction rate at or for this system increases as temperature increases. However, below a temperature of 50° C., the gassing reaction rate is negligible. This indicates that the gassing reaction may be effectively stopped by cooling the gassed cartridge to below this temperature.

EXAMPLES 8 TO 10

Commonly known accelerators for the gassing reaction of emulsion explosives using aqueous sodium nitrite include, for example, sodium thiocyanate, sodium acetate, and thiourea. The effect of these accelerators on the system of the present invention was studied and the results are shown in Table 5. the gassing rate of the emulsions prepared were determined at 95° C. and were compared to the 97° C. gassing rate of the emulsion of Examples 4 to 7 with a 37–44 μm sodium nitrite particle size (from Table 4). The formulation for the accelerated emulsions studied was as follows:

| | |
|---|---|
| E-476 (PIBSA based surfactant) | 2.0 |
| Sorbitan sesquioleate | 0.5 |
| Polyethylene wax | 1.2 |
| Microcrystalline wax | 0.6 |
| Paraffin oil | 1.2 |
| Oxidizing liquor | 93.72 |
| Sodium nitrate powder (37 to 42 microns) | 0.3 |
| Accelerator | 0.48 |

TABLE 5

Effect of Accelerators on Gassing Rate

| | EXAMPLE NO. | | | | | |
|---|---|---|---|---|---|---|
| | 6 | 8 | 9 | | 10 | |
| Accelerator | None | Sodium Acetate | Thiourea | | Sodium Thiocyanate | |
| Density (g/cc) Time (min): | | | | | | |
| 0 | 1.41 | 1.33 | 1.34 | Time (min) | 0 | 1.30 |
| 10 | 1.22 | 1.17 | 1.17 | | 4 | 1.20 |
| 20 | 1.09 | 1.00 | 1.01 | | 7 | 1.13 |
| 30 | 1.02 | — | — | | 10 | 1.08 |
| | | | | | 14 | 1.03 |

The results show that the accelerators are effective in increasing the gassing reaction rate, particularly sodium thiocyanate.

I claim:

1. A process for the production of a chemically gassed emulsion explosive comprising:

(a) mixing a liquid fuel component with an effective amount of a suitable emulsifying surfactant to prepare a fuel/surfactant admixture;

(b) mixing an oxidizer salt component with said admixture in order to prepare an emulsion explosive;

(c) adding a chemical gassing agent to said emulsion explosive; and (d) reacting said gassing agent in said emulsion explosive to effect production of a chemically gassed blasting agent, wherein the improvement comprises that said gassing agent is added as an essentially dry particulate material.

2. A process as claimed in claim 1 wherein said gassing agent is an alkali nitrite.

3. A process as claimed in claim 2 wherein aid gassing agent is sodium nitrite.

4. A process as claimed in claim 3 wherein said sodium nitrite has a particle size of between 37 and 74 microns.

5. A process as claimed in claim 1 wherein said gassing agent is caused to react by heating or maintaining the gassing agent-containing emulsion explosive at least about 70° C.

6. A process as claimed in claim 1 wherein said gassing agent is caused to react after the gassing agent-containing emulsion explosive has been cartridged.

7. A process as claimed in claim 1 wherein said fuel is mineral oil, waxes, paraffin oils, benzene, toluene, xylenes, and mixtures of petroleum distillates such as gasoline, kerosene and diesel fuel.

8. A process as claimed in claim 1 wherein said surfactant is a mixture of sorbitan sesquioleate and a polyisobutylene succinic anhydride based surfactant.

9. A process as claimed in claim 1 wherein said oxidizer salt is ammonium nitrate, sodium nitrate, calcium nitrate, potassium nitrate, or mixtures thereof.

10. An emulsion explosive comprising:

(i) a continuous fuel phase;

(ii) a discontinuous aqueous oxidizer salt phase; and (iii) a chemical gassing agent wherein said gassing agent was added to said emulsion explosive as an essentially dry particulate material.

11. An emulsion explosive prepared by the process as described in any one of claims 1 to 9.

* * * * *